United States Patent [19]

Shapiro et al.

[11] Patent Number: 5,068,772

[45] Date of Patent: Nov. 26, 1991

[54] RECESSED LIGHTING FIXTURE

[75] Inventors: James Shapiro, Placentia; Bogdan Zakrzewski, Fontana, both of Calif.

[73] Assignee: Troy Lighting, Inc., City of Industry, Calif.

[21] Appl. No.: 575,322

[22] Filed: Aug. 30, 1990

[51] Int. Cl.[5] ..... F21S 1/06

[52] U.S. Cl. ..... 362/365; 362/368; 362/147; 248/343

[58] Field of Search ..... 362/145, 147, 364, 365, 362/374, 148, 368, 150, 148; 52/28; 248/343

[56] References Cited

U.S. PATENT DOCUMENTS

| | | | |
|---|---|---|---|
| 4,293,895 | 10/1981 | Kristofek | 362/364 |
| 4,424,554 | 1/1984 | Woloski et al. | 362/365 |
| 4,636,924 | 1/1987 | Targetti | 362/364 |
| 4,733,339 | 3/1988 | Kelsall | 362/365 |
| 4,739,460 | 4/1988 | Kelsall | 362/368 |

FOREIGN PATENT DOCUMENTS

| | | | |
|---|---|---|---|
| 223098 | 7/1959 | Australia | 362/365 |
| 249102 | 1/1964 | Australia . | |
| 253441 | 8/1964 | Australia . | |
| 1103237 | 8/1957 | Fed. Rep. of Germany . | |
| 1268272 | 9/1960 | France . | |
| 1304849 | 8/1962 | France . | |
| 811148 | 4/1959 | United Kingdom . | |

*Primary Examiner*—Ira S. Lazarus

*Assistant Examiner*—D. M. Cox

*Attorney, Agent, or Firm*—Pasquale A. Razzano

[57] ABSTRACT

A recessed lighting fixture including a housing having spaced apart generally vertical walls defining an interior and an open bottom end. The walls have generally vertical slots through them. The fixture has lip means for maintaining the bottom end of the housing against a lower surface of a ceiling. The fixture further includes a plurality of mounting members disposed on an exterior surface of the wall means. Each of these mounting members has a first end, an outwardly curved elongated body portion made of resilient material and a second end. The first end of each mounting member is attached to the housing near the bottom end of the housing. The second end of the mounting member extends at least partially through the slot into the interior of the fixture so that at least a portion of the second end is accessible from the interior through the open bottom end. The second end is slidable within the slot so that, when the lighting fixture is inserted into the hole in the ceiling, sliding the second end to a lower position along the slot increases the degree of curvature of the curved elongated body portion above an upper surface of the ceiling to urge the elongated body portions against the ceiling to secure the fixture. The fixture further includes means for selectively locking the second end at the lower position along the slot.

8 Claims, 4 Drawing Sheets

RECESSED LIGHTING FIXTURE

BACKGROUND OF THE INVENTION

The present invention relates to recessed lighting fixtures, and in particular to a recessed lighting fixture having resilient mounting means.

There has come into wide use a class of lighting fixtures generally referred to as recessed lighting fixtures. Recessed lighting fixtures are lighting fixtures which may be installed in an appropriately sized hole in a wall or ceiling so that, once installed, the lighting fixture is substantially flush with the exposed surface of the wall or ceiling. Use of recessed lighting fixtures is popular in both new construction, and in remodeling where the recessed lighting fixture is installed in an existing wall or ceiling.

In both new construction and particularly in remodeling, it may difficult to gain access to the hidden side of the wall or ceiling. Accordingly, recessed lighting fixtures must be designed so they can be installed from the exposed side of the wall or ceiling. Likewise, it is necessary that recessed lighting fixtures be removable for replacement, repair or access to the wiring inside the ceiling without access to the hidden side of the wall or ceiling. Furthermore, recessed lighting fixtures must generally be installed in ceilings with the lighting fixture overhead and in an awkward position. Because of this, it is desirable that recessed lighting fixtures be designed so that installation and removal is simple and quick, to minimize worker fatigue. Furthermore, because it is not always possible to position the recessed lighting fixture in the hold perfectly the first time, it is desirable that the recessed lighting fixture be repositionable without damage to the wall or ceiling from installation which would impair subsequent repositioning efforts. Still further, a recessed lighting fixture should be adaptable to installation in walls or ceilings of different constructions and different wall or ceiling thicknesses.

Although various designs for mounting recessed lighting fixtures have been proposed to attempt to meet some of these objectives, such designs have not been entirely successful. In one type of design, exemplified by U.S. Pat. No. 4,048,491 issued Sept. 13, 1977, the recessed lighting fixture is provided with screw threads about its exterior periphery and a lower lip adapted to bear against the underside of the ceiling. Flanges are attached to each of the screw threads so that by screwing in the screw threads, the flange is brought into contact with the upper side of the ceiling, squeezing the ceiling between the flange and the opposing lip. Although such a design accomplishes the objective of securing a recessed lighting fixture in a variety of ceiling thicknesses, screwing in the screw threads and securing the flange is slow and cumbersome.

Another type of design is exemplified by French Patent No 1.304.849, issued Aug. 20, 1972. In this type of design, the fixture is secured by means of a leg member which is pivoted to the vertical wall of the lighting fixture near the bottom of the fixture. The leg has a bracing member at its upper end which extends into the interior of the lighting fixture. The leg is maintained generally flush with the wall of the lighting fixture during installation of the fixture into the hole in the ceiling. When it is desired to secure the fixture, the bracing member is pressed outwardly from the interior of the fixture so as to pivot the leg into engagement with the ceiling. The bracing member is then locked into position to secure the fixture.

Although this type of design eliminates the slow and cumbersome threading operation of U.S. Pat. No. 4,048,491 and can accommodate ceilings of different thicknesses, the bracing member extends a substantial distance into the interior of the lighting fixture, where it may interfere with other elements of the lighting fixture. Furthermore, the bracing member can exert considerable leverage against the pivoted leg member. Thus, when the leg is braced against the ceiling, the leg may tend to crush or otherwise damage the rim of the ceiling. This may limit repositioning efforts, or require repair of the ceiling.

Accordingly, it can be seen that there is a need for a recessed lighting fixture which affords simple and rigid installation, is adaptable to walls or ceilings of a variety of thicknesses, is readily repositionable, will have a lesser tendency to damage the wall or ceiling during installation, and which eliminates the need for bracing members extending far into the interior of fixture where they might interfere with other components of the lighting fixture.

SUMMARY OF THE INVENTION

These objects are achieved in a recessed lighting fixture in accordance with a preferred embodiment of the present invention. In this preferred embodiment, the recessed lighting fixture includes housing means having spaced apart generally vertical wall means defining an interior and an open bottom end, which wall means have generally vertical slots therethrough. The fixture further includes a plurality of mounting members disposed on an exterior surface of the wall means. Each of these mounting members has a first end, an outwardly curved elongated body portion made of resilient material and a second end. The first end of each mounting member is attached to the housing means near the bottom end of the housing. This end provides a flange for maintaining the bottom end of the housing against the lower surface of the ceiling. The second end of the mounting member extends at least partially through the slot into the interior of the fixture so that at least a portion of the second end is accessible from the interior through the open bottom end, the second end further being slidable within the slot so that, when the lighting fixture is inserted into the hold in the ceiling, sliding the second end to a lower position along the slot increases the degree of curvature of the curved elongated body portion above an upper surface of the ceiling to urge the elongated body portion against the ceiling to secure the fixture. The fixture further includes means for selectively locking the second end at any of a plurality of lower positions along the slot thereby to hold the elongated body portion in its curved configuration.

BRIEF DESCRIPTION OF THE DRAWINGS

These and other advantages and features of the present invention will be best understood by those skilled in the art with reference to the accompanying drawings and descriptions, wherein.

DETAILED DESCRIPTION

Figure 1:
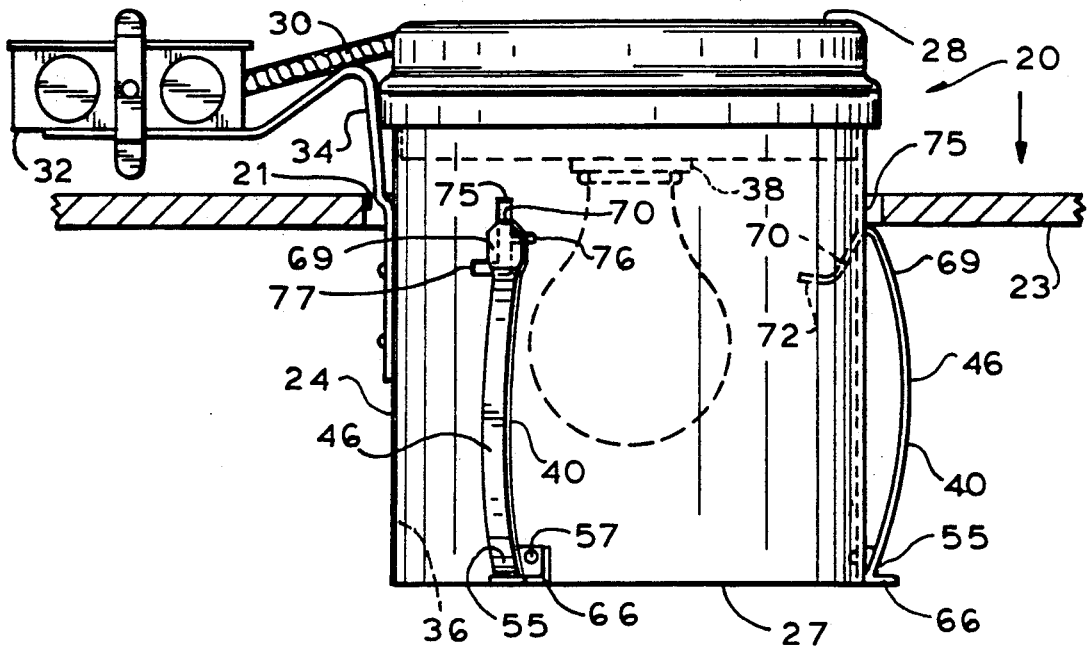
FIG. 1 is an elevational view of a lighting fixture in accordance with a preferred embodiment of the present invention, showing the fixture partially inserted into the ceiling, with the resilient mounting means in an unstressed, first position.

Referring now to the drawings in detail, and initially to FIG. 1 thereof, a recessed lighting fixture 20 in accordance with a preferred embodiment of the present invention is depicted partially inserted into an appropriately sized hole 21 in a ceiling 23. Recessed lighting fixture 20 includes a generally cylindrical housing 24 having generally vertical walls, which are spaced apart to form a generally open interior 36. Other shapes for the housing besides cylindrical may be employed, of course. An upper cap 28 is advantageously provided at the upper end of housing 24. Conveniently, a light socket 38 is positioned inside the housing 24 in any convenient manner and flexible conduit 30 containing electrical wiring is connected to cap 28. An electrical junction box 32 is also advantageously attached to housing 24 by means of bracket 34. Housing 24 terminates in an open bottom end 27, so that the interior 36 of housing 24 can be manually accessed through the open bottom end 27.

To retain recessed lighting fixture 20 in position in the ceiling, three elongated clips 40 are provided for mounting the fixture (only two of which are visible in FIG. 1). Although three clips 40 are depicted, it will be understood by those skilled in the art that greater or lesser numbers of clips may also be employed.

Each of the clips 40 has an outwardly curved body portion 46, and is preferably made of a resilient material, such as flat spring steel. The body portion is outwardly curved even when the clip is unstressed. The degree of curvature is preferably such that, when the clip in an unstressed condition, as depicted in FIG. 1, the outwardmost portion of the curve extends farther than the diameter of hole 21.

Figure 6:
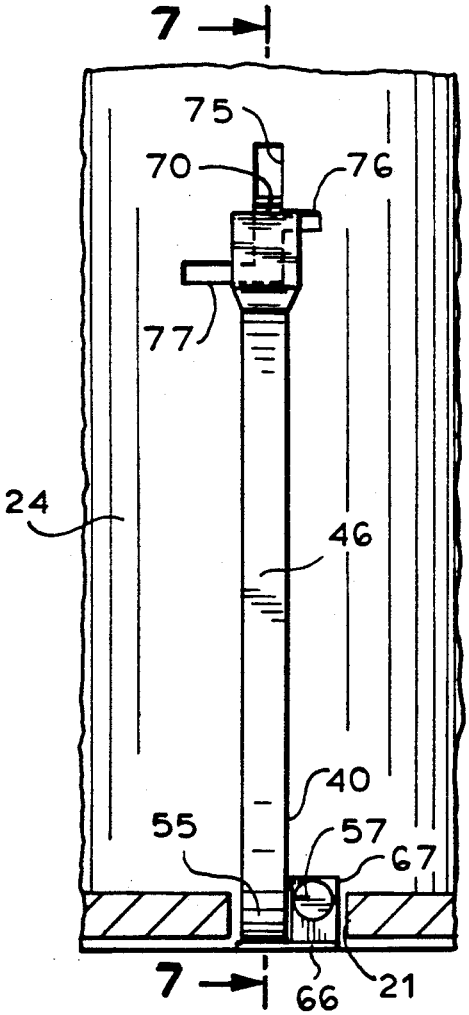
FIG. 6 is a detailed exterior side view of a portion of the lighting fixture depicted in FIG. 3, showing the mounting member in the partially stressed position.

Preferably, as shown in FIGS. 1 and 6, the lower end 55 of clip 40 includes a dogleg portion 66 extending generally perpendicularly to the vertical wall of housing 24 and at right angles to the axis of clip 40. Dogleg portion 66 is integrally formed with mounting flange 67 of clip 40. Mounting flange 67 is attached to the lower end of housing 24 by convenient means, such as rivet 57. Although a pivoted connection may also be employed, the riveted connection tends to maximize flexing of the elongated body portion of clip 40 so that it's lower end is as horizontal as possible where it engages the ceiling. By maximizing the flexing of the clip at this point securement of the fixture is improved and the risk of damaging the ceiling by crushing with the clip is minimized. Dogleg portion 66 also functions as a radially extending lip, which serves to position the lower end of housing 24 flush with the lower side of ceiling 23, when lighting fixture 20 is fully installed. Of course, a separate lip formed of or attached to the lower portion of housing 24 could also be employed to serve the same purpose.

Figure 5:
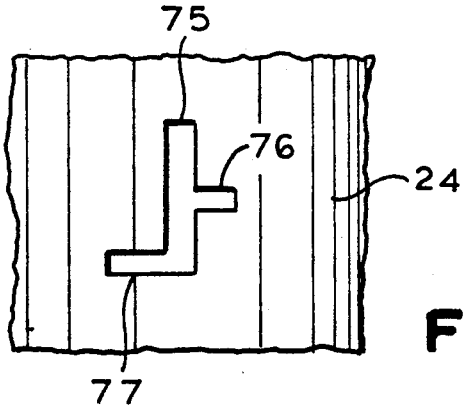
FIG. 5 is detailed side view of the upper portion of the slot on the wall of the fixture depicted in FIG. 3.

Clip 40 includes an upper end 69, which is preferably slightly wider than the width of body portion 46, and a narrowed neck 70 which fits into vertical slot 75 through the wall of housing 24. Slot 75 includes a first notch 76 extending to one side and second notch 77 extending to the other side. The arrangement of slot 75 and notches 76 and 77 is also depicted in FIG. 5. Of course, notches 76 and 77 could also be positioned on the same side of slot 75, and more or less than two notches could be provided, if desired. Preferably, neck 70 terminates in a fingerhold 72 which is slightly wider then the width of slot 75 to retain neck 70 within slot 75 and to facilitate manipulation of the upper end of clip 40. Fingerhold 72 extends into the interior of fixture 20, but preferably does not extend so far into the interior to interfere with other components of the lighting fixture.

Mounting of the lighting fixture 20 in hole 21 of ceiling 23 and securing of the fixture to the ceiling by means of clips 40 will now be described, initially with reference to FIGS. 1-3, in order. Referring first to FIG. 1, lighting fixture 20, preferably with conduit 30 and junction box 32 already attached, is inserted upwardly into hole 21 cut into ceiling 23. Hole 21 is sized sufficiently large to permit ready insertion of fixture 20 into the hole, but not so large that the dogleg portion 66 will not be able to rest flush with the lower surface of the ceiling. During the beginning of insertion depicted in FIG. 1, the body portions of clip 40 are preferably in their curved but unstressed condition, positioned with neck 70 within slot 75, but not locked within either of notches 76 or 77. In this position, neck 70 is free to slide up or down within vertical slot 75.

Figure 2:
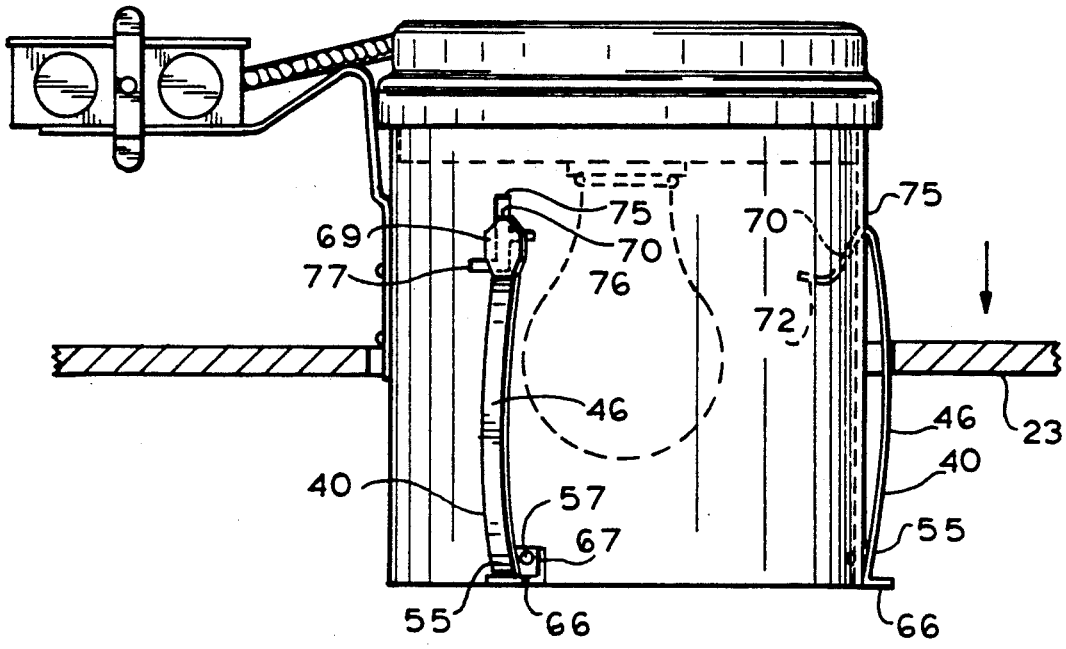
FIG. 2 is an elevational view of a lighting fixture in accordance with a preferred embodiment of the present invention, showing the fixture partially inserted approximately midway into the ceiling, with the resilient mounting means urged toward the wall of the housing by the ceiling.

Turning now to FIG. 2, lighting fixture 20 is depicted midway through the insertion operation, with resilient curved clips 40 resiliently deformed inwardly somewhat toward the walls of housing 24 by virtue of being forced through hole 21.

Figure 3:
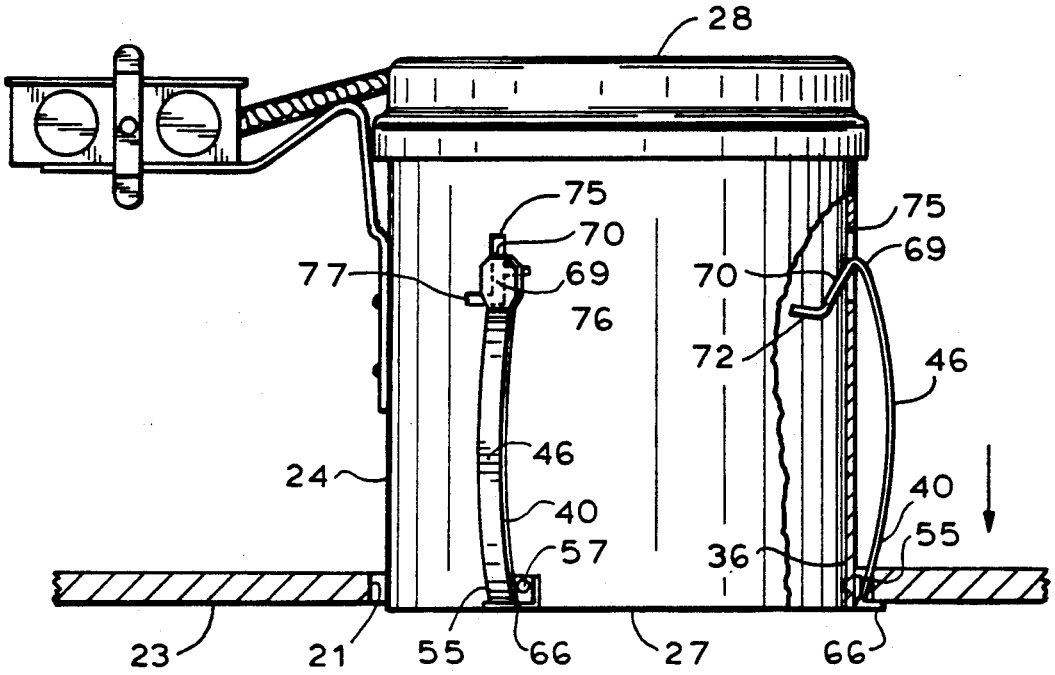
FIG. 3 is an elevational view of a lighting fixture in accordance with a preferred embodiment of the present invention, showing the fixture fully inserted into the ceiling, with the resilient mounting means in a partially stressed position.
Figure 4:
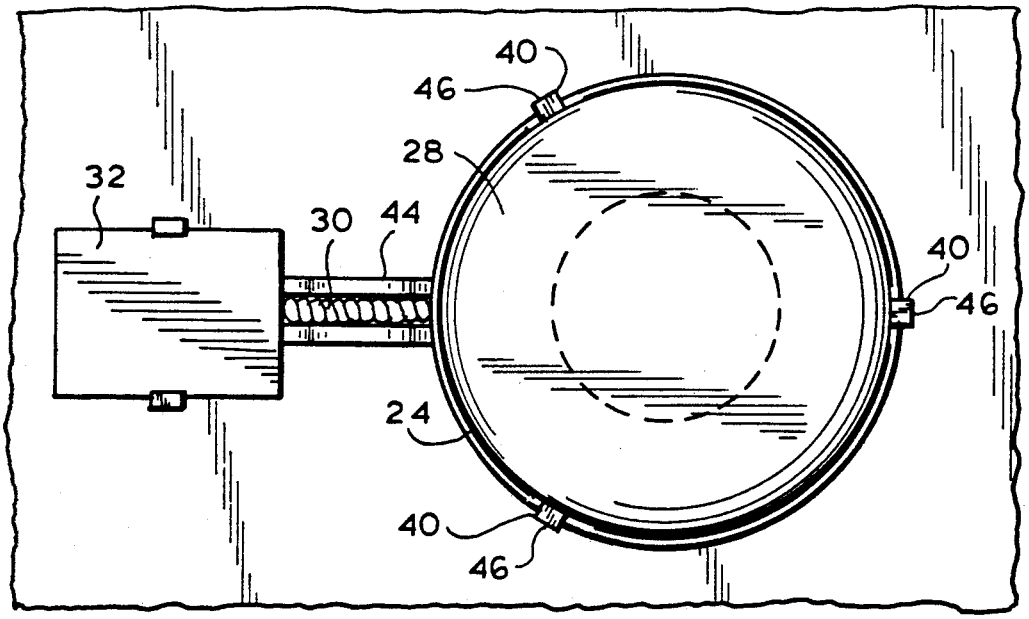
FIG. 4 is a plan view from the upper or hidden side of the ceiling and lighting fixture depicted in FIG. 3.
Figure 7:
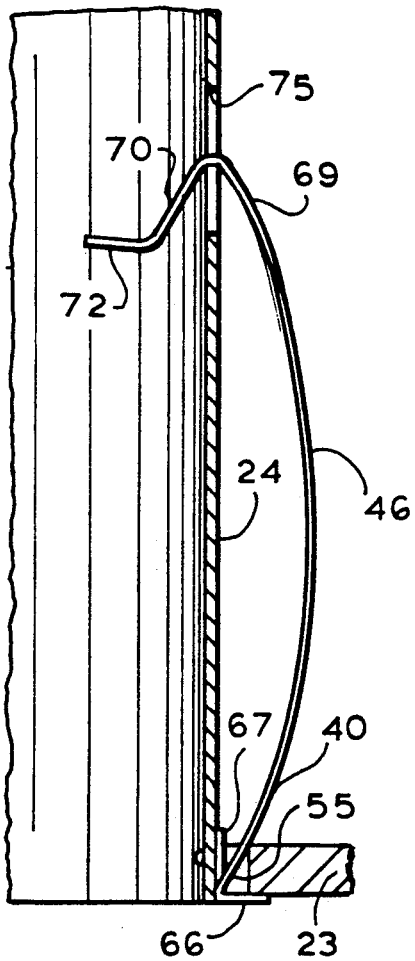
FIG. 7 is a detailed cross-sectional view of a portion of the lighting fixture of FIG. 6 taken along the line 7—7, showing the mounting member in the partially stressed position.
Figure 11:
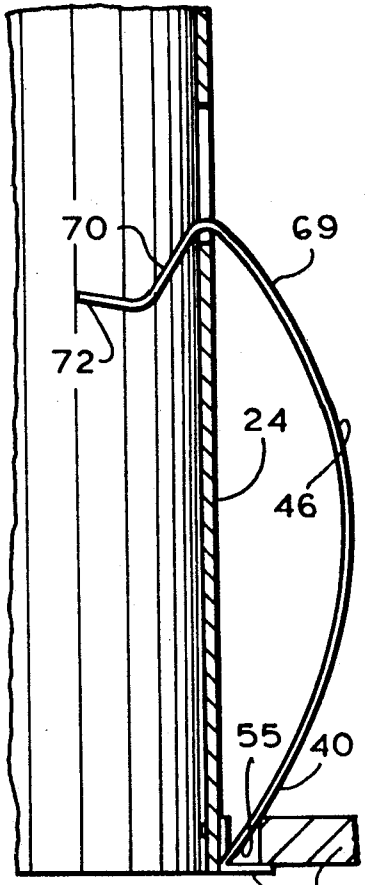
FIG. 11 is a detailed cross-sectional view taken along the line 11—11 of the portion of the lighting fixture depicted in FIG. 10.
Figure 10:
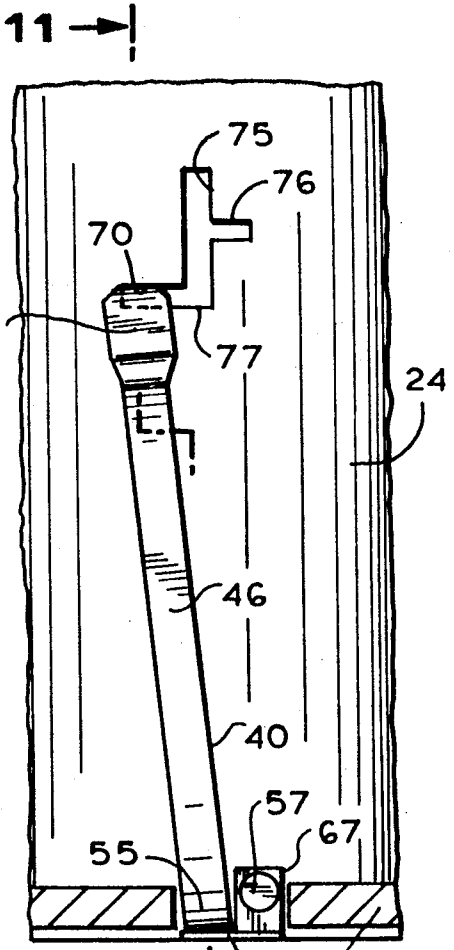
FIG. 10 is a detailed exterior view of a portion of the lighting fixture fully inserted into the ceiling, showing the mounting means positioned in the lowermost notch in the slot of the housing wall to increase the degree of curvature to the greatest degree.
Figure 9:
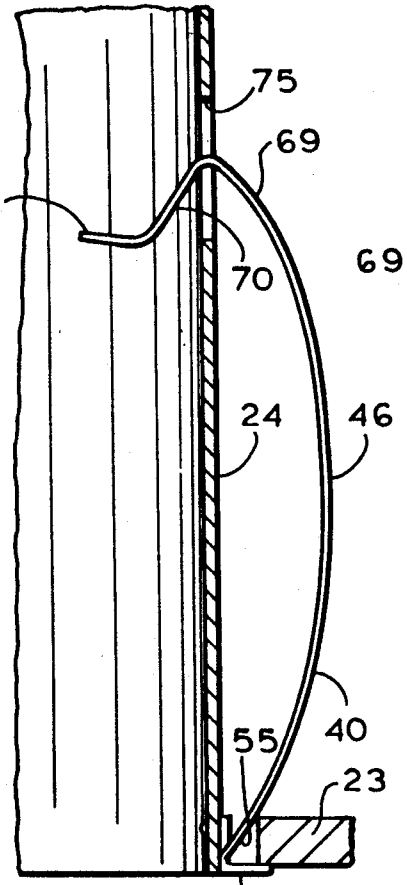
FIG. 9 is a detailed cross-sectional view taken along the line 9—9 of the portion of the lighting fixture depicted in FIG. 8.
Figure 8:
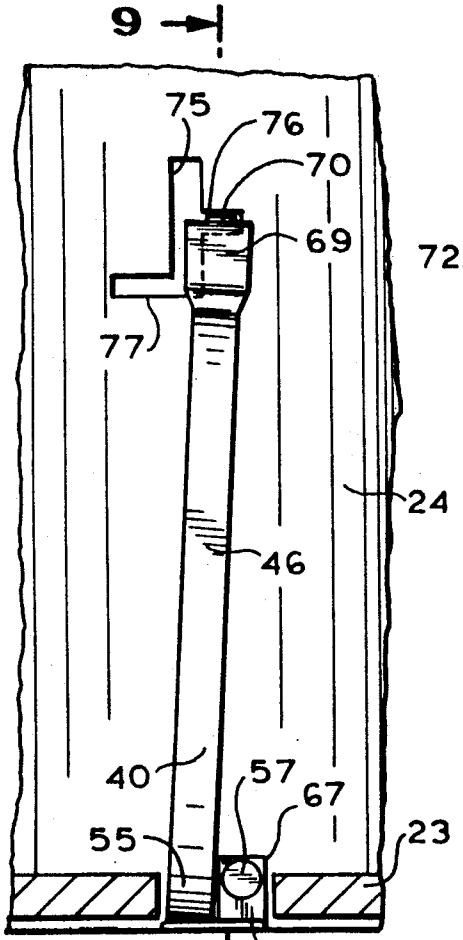
FIG. 8 is a detailed exterior view of a portion of the lighting fixture fully inserted into the ceiling, showing the mounting means positioned in an intermediate notch in the slot of the housing wall to increase the degree of curvature of the body portion of the mounting means.

Turning now to FIG. 3 and also to FIGS. 6 and 7, lighting fixture 20 is depicted fully inserted into hole 21 in ceiling 23 with lips of dogleg portion 66 abutting the lower surface of ceiling 23. In this position, the outwardly curved body portions of clips 40 resiliently spring back towards their fully outwardly arched condition, thus exerting a spring force against the upper portion of the rim of hole 21.

The degree of spring force exerted by clips 40 against the rim should preferably be sufficient to maintain the recessed lighting fixture 20 in position, but not so great as to significantly crush or otherwise permanently deform the rim. Thus, if the initial insertion position is not correct, the fixture 20 can be easily repositioned without damage to the ceiling rim until the desired final position is attained. Furthermore, since the spring force is preferably sufficient to hold the fixture in position, it will not be necessary to manually hold the fixture in place against the underside of the ceiling until the final positioning is achieved. This helps to minimize worker fatigue.

As shown in FIGS. 8–11, once the correct positioning of lighting fixture 20 is achieved, the upper end of clip 40 can be manually pulled down by means of finger hold 72, thereby sliding neck 70 downwardly along vertical slot 75, to increase the degree of curvature of the arch in the body portion 46 of clip 40. Increasing this degree of curvature correspondingly increases the amount of resilient urging of the clip against the rim of the ceiling. Once the desired degree of curvature is achieved, the neck 70 is slid sideways into either notch 76 of 77. Fingerhold 72 may now be released, and clip 40 will be securely locked into position. Because the fingerhold 72 is slid along the wall of the housing, rather than being moved in or out through the wall, the tendency of the fingerhold to interfere with internal components of the lighting fixture is minimized. This procedure is repeated for the other clips 40 of lighting fixture 20 until all clips are locked in place. If it is desired to remove the fixture from the ceiling, neck 70 is slid sideways out of notch 76 or 77 into the vertical slot 75. Lighting fixture 20 may now be removed in reverse manner to how it was inserted.

As is clear from the foregoing, the present invention provides a recessed lighting fixture which can be easily and quickly installed, repositioned, and removed with a minimum risk of damage to the ceiling. Although an illustrative embodiment of the present invention has been described herein with reference to the accompanying drawings, it is to be understood that various changes and modifications can be made therein by those skilled in the art without departing from the scope or spirit of this invention, and there is no intention of limiting the invention to the precise embodiment shown. Rather, the scope of the invention is to be defined by the appended claims.

I claim:

1. A recessed lighting fixture adapted for mounting in a hole having a predetermined diameter in a ceiling, and fixture comprising:

housing means having spaced apart generally vertical wall means defining an interior and having an open bottom end, said wall means having generally vertical slots therethrough;

lip means for maintaining the bottom end of said housing means against a lower surface of said ceiling;

a plurality of mounting members disposed on an exterior surface of said wall means, each of said mounting members having a first end, an outwardly curved elongated body portion made of resilient material and a second end, said first end being attached to said housing means near said bottom end, said second end extending at least partially through said slot into said interior so that at least a portion of said second end is accessible from said interior through said open bottom end, said elongated body portions having a sufficient degree of outward curvature in their unstressed condition such that the outwardmost portion of the curve extends farther than said predetermined diameter of the hole and a sufficient degree of resiliency to create an initial spring force upon insertion of said fixture into said hole, said initial spring force being of sufficient magnitude to retain said fixture in position upon said insertion, said second end further being vertically slidably retained within said slot so that, when said lighting fixture is inserted into said hold in said ceiling, sliding said second end to a lower position along said slot increases the degree of curvature of said curved elongated body portion above an upper surface of said ceiling to urge said elongated body portion against said ceiling to more securely hold said fixture; and means for selectively locking said second end at said lower position along said slot.

2. The recessed lighting fixture defined in claim 1, wherein said first ends of said mounting members are at all times during use fixedly attached to said housing.

3. The recessed lighting fixture defined in claim 1, wherein said first ends of said mounting members are pivotably attached to said housing.

4. The recessed lighting fixture defined in claim 1, wherein said first ends of said mounting members include a dogleg extension and mounting flange, said dogleg extension extending generally tangent to a horizontal circle drawn around the periphery of said wall of said housing and said mounting flange being fixedly attached to said housing.

5. A recessed lighting fixture adapted for mounting in a hole in a ceiling, said fixture comprising:

housing means having spaced apart generally vertical wall means defining an interior and having an open bottom end, said wall means having generally vertical slots therethrough, each of said slots having at least one side notch at a lower position along said slot;

lip means for maintaining the bottom end of said housing means against a lower surface of said ceiling;

a plurality of mounting members disposed on an exterior surface of said wall means, each of said mounting members having a first end, an outwardly curved elongated body portion made of resilient material and a second end, said first end being attached to said housing means near said bottom end, said second end including a portion on the exterior of said wall means, a neck portion extending at least partially through said slot into said interior and slidably retained therein and in a fingerhold accessible from said interior through said open bottom end, said elongated body portions having a sufficient degree of outward curvature in their unstressed condition such that the outwardmost portion of the curve extends farther than said predetermined diameter of the hole and a sufficient degree of resiliency to create an initial spring force upon insertion of said fixture into said hole, said initial spring force being of sufficient magnitude to retain said fixture in position upon said insertion, said neck portion further being vertically slidable within said slot so that, when said lighting fixture is inserted into said hole in said ceiling, sliding said neck portion to a lower position along said slot increases the degree of curvature of said curved elongated body portion above an upper surface of said ceiling to urge said elongated body portion against said ceiling to more securely hold said fixture, said neck portion further being selectively positionable into said notch to lock said neck portion at said lower position along said slot.

6. The recessed lighting fixture defined in claim 5, wherein said first ends of said mounting members are at all time fixedly attached to said housing.

7. The recessed lighting fixture defined in claim 5, wherein said first ends of said mounting members are pivotably attached to said housing.

8. The recessed lighting fixture defined in claim 5, wherein said first ends of said mounting members include a dogleg extension and mounting flange, said dogleg extension extending generally tangent to a horizontal circle drawn around the periphery of said wall of said housing and said mounting flange being fixedly attached to said housing.

* * * * *